United States Patent [19]

Blanc

[11] Patent Number: 4,724,790

[45] Date of Patent: Feb. 16, 1988

[54] SUBMERSIBLE BELL

[76] Inventor: Max A. Blanc, 830 S. Ocean Blvd., Palm Beach, Fla. 33480

[21] Appl. No.: 927,048

[22] Filed: Nov. 4, 1986

[51] Int. Cl.[4] ..... B63C 11/02

[52] U.S. Cl. ..... 114/315; 114/331; 405/185; 405/192

[58] Field of Search ..... 114/312, 314, 315, 330, 114/331, 332, 333, 335, 66; 405/185, 186, 187, 188, 189, 192, 193, 194

[56] References Cited

U.S. PATENT DOCUMENTS

| | | | |
|---|---|---|---|
| 1,313,838 | 8/1919 | Stodder | 405/194 X |
| 1,866,438 | 7/1932 | Williamson | 405/192 X |
| 2,627,727 | 2/1953 | Sellers | 405/185 |
| 3,408,822 | 11/1968 | Chate et al. | 405/192 |
| 3,543,526 | 12/1970 | O'Neill et al. | 405/193 |
| 3,625,171 | 12/1971 | Bailey | 114/314 |
| 3,640,079 | 2/1972 | Therisien | 405/189 |
| 3,800,722 | 4/1974 | Lepage | 114/333 |
| 3,987,742 | 10/1976 | Boisrayon et al. | 114/335 |
| 3,996,870 | 12/1976 | Haavie | 114/66 |
| 4,071,024 | 1/1978 | Blanc | 128/201.11 |
| 4,087,980 | 5/1978 | Kono | 114/314 X |
| 4,411,213 | 10/1983 | Laukien | 114/312 |

FOREIGN PATENT DOCUMENTS

| | | | |
|---|---|---|---|
| 2155706 | 5/1973 | France | 405/192 |
| 2380393 | 10/1978 | France | 405/185 |

*Primary Examiner*—Joseph F. Peters, Jr.
*Assistant Examiner*—Paul E. Salmon
*Attorney, Agent, or Firm*—Brumbaugh, Graves, Donohue & Raymond

[57] ABSTRACT

A submersible bell having a diver's compartment in the upper region thereof, a depending conduit from the diver's compartment to provide a passage for the diver to enter and leave the diver's compartment within the bell and a spiral wall between the bell and depending conduit to provide a winding passage for purging air from the diver's compartment to the water and/or for the diver to enter and leave the diver's compartment within the bell.

A submersed bell having a conduit connecting a diver's compartment with the bell and a spiral passage between the bell and the conduit, the conduit and spiral passage permitting a diver to enter and leave the diver's compartment and also purging air from the diver's compartment.

12 Claims, 9 Drawing Figures

SUBMERSIBLE BELL

This invention relates to a submersible bell and, in particular, to a submersible bell having a compartment in the upper region thereof for accommodating a diver, an axial conduit from the compartment and depending from the bell to connect the compartment with the ambient water or another compartment, and a spiral wall between the bell and the depending conduit to provide a passage for purging air from the diver's compartment to the water and/or for the diver to enter and leave the diver's compartment within the bell. The bell utilizes the principle of operation of the air purge and valve device employed in the snorkel disclosed in my U.S. Pat. No. 4,071,024, issued Jan. 31, 1978.

The bell can be used in a floating mode or in a submersed mode. The invention can also be used in connection with an underwater station to purge air from a diver's compartment and/or to permit a diver to enter and leave a diver's compartment. When the bell is submerged, air can be supplied to the diver's compartment through an umbilical conduit or from a compressed air supply carried by the bell.

For a more complete understanding of the present invention, reference can be made to the detailed description which follows and to the accompanying drawings in which.

Figure 2:
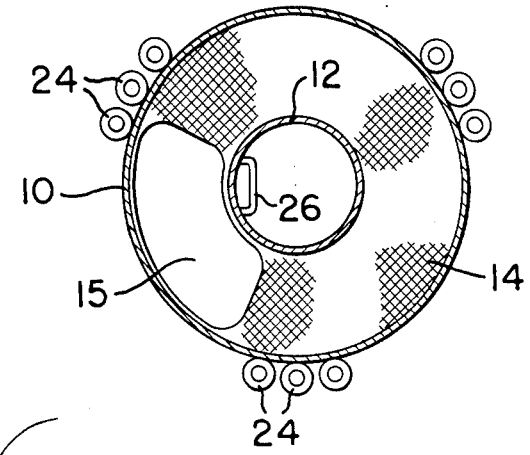
FIG. 2 is a sectional view of the bell shown in FIG. 1 taken along the line 2—2 looking in the direction of the arrows.
Figure 1:
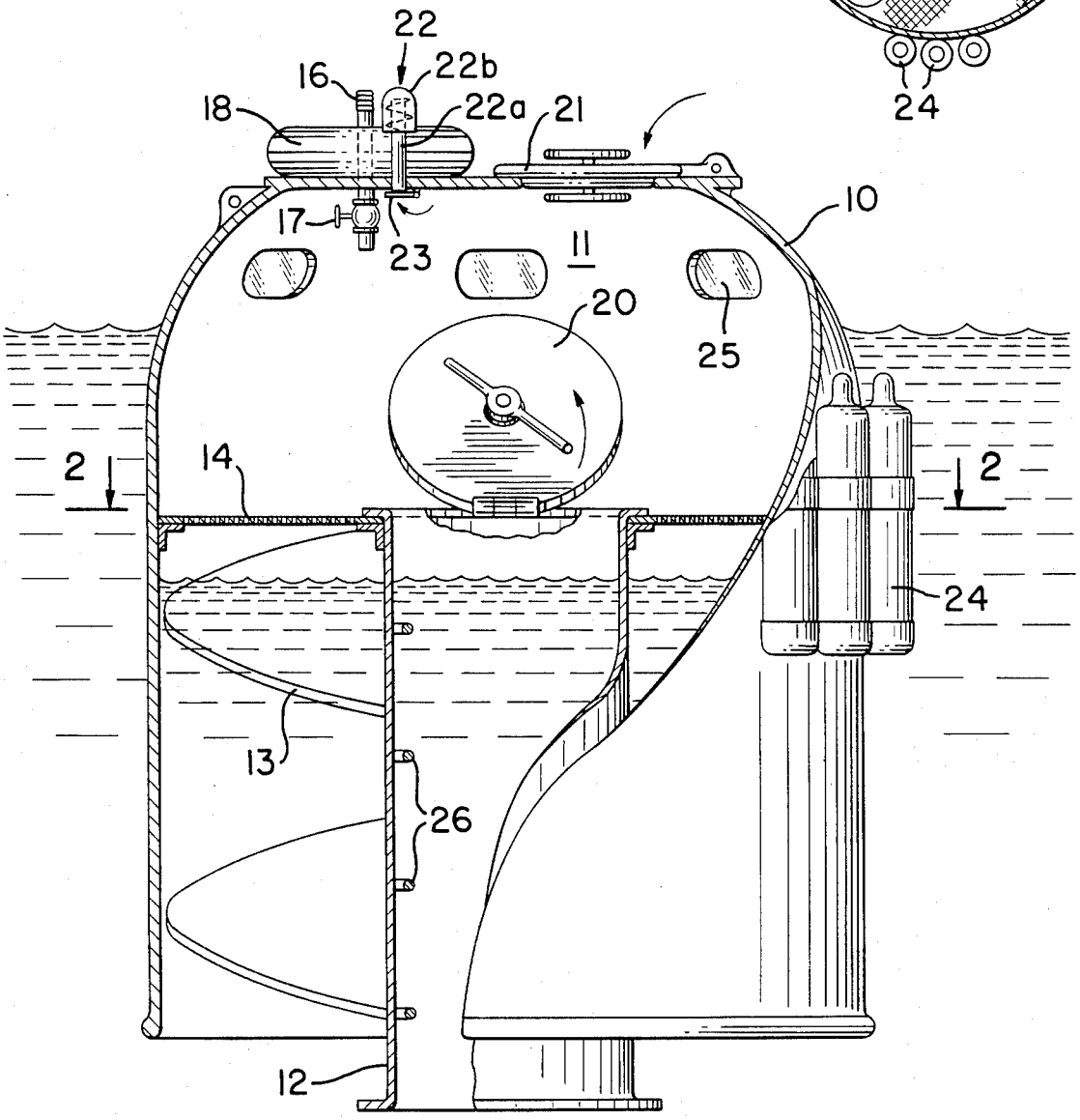
FIG. 1 is a sectional, elevational view of a submersible bell embodying the present invention.

The floatable and submersible bell 10, shown in FIG. 1, has a compartment 11 in its upper region large enough to accommodate one or more divers. An axial conduit 12 extends from the lower region of the compartment 11 downwardly below the lower end of the bell. A spiral wall 13 forms a winding passage between the outer surface of the axial conduit and the inner surface of the bell. This winding passage is in open communication at one end with the compartment 11 and at the other end with the ambient water.

A grill floor 14 forms the base of the diver's compartment. The floor 14 has an opening 15 which communicates with the upper end of the winding passage to permit a diver to enter and leave the compartment.

The upper end of the bell carries an umbilical conduit 16 to supply air to the compartment 11 through a valve 17. The bell can also be equipped with a tank 18 containing compressed air or oxygen for supply to the compartment through the valve 17. The umbilical conduit can be used to supply air or oxygen to the tank 16 or directly to the compartment.

When the bell is placed in the water, the water will flow upwardly through the winding passage until the air compressed in the compartment prevents further upward flow. The water will also rise in the axial conduit if the lower end is in open communication with the water.

The bell will ordinarily float in the water. However, it can be submerged, for example, by decreasing the air pressure in the diver's compartment and/or by applying weights or anchors. The compartment 11 can be maintained free of water by regulating the pressure therein. Air can be purged from the compartment through the spiral passage. In rough seas the bell can tilt significantly from an upright position while maintianing the air pressure within the compartment.

The upper end of the axial conduit 12 can be closed and sealed by a hatch door 20. When the hatch door 20 is closed and an air pocket is entrapped in the upper region of the conduit 12 to float the bell, the divers can enter and leave the compartment 11 through an opening in the upper end of the bell that is normally closed and sealed by a hatch door 21. When the bell is submerged and the hatch door 21 is closed, the diver may enter and leave the compartment 11 through the axial conduit 12 by opening the hatch door 20 or through the winding passage. The winding passage will ordinarily be used by the diver in rougher water and when it is desirable to maintain the hatch door 20 closed to control the buoyancy of the bell.

A small air purge and valve device 22, of the type described in my above-identified patent, is provided in the upper wall of the bell to permit air to be purged from the compartment 11 when the bell is floating or submerged. This device 22 includes a conduit *22a* in communication at its lower end with the compartment 11 and a bell *22b* at the upper end of the conduit *22a* supported on the conduit by a spiral wall between the bell and the conduit. A closure 23 at the lower end of the conduit *22a* is normally maintained closed by the pressure in the compartment, but the closure can be opened to purge air from the compartment. When the bell is submerged and the closure 23 is open, the pressure within the compartment will purge the air and prevent entry of water.

The bell has provision on the exterior thereof for supporting a plurality of air or oxygen tanks 24 for use of the divers so that they do not have to bring the tanks into the compartment 11. These tanks may also be used to replenish the oxygen within the compartment 11.

Sealed windows 25 are provided in the compartment region of the bell to permit the occupants to view their surrounding. Also, ladder rungs 26 are provided in the axial conduit 12 for the convenience of the divers.

Figure 3A:
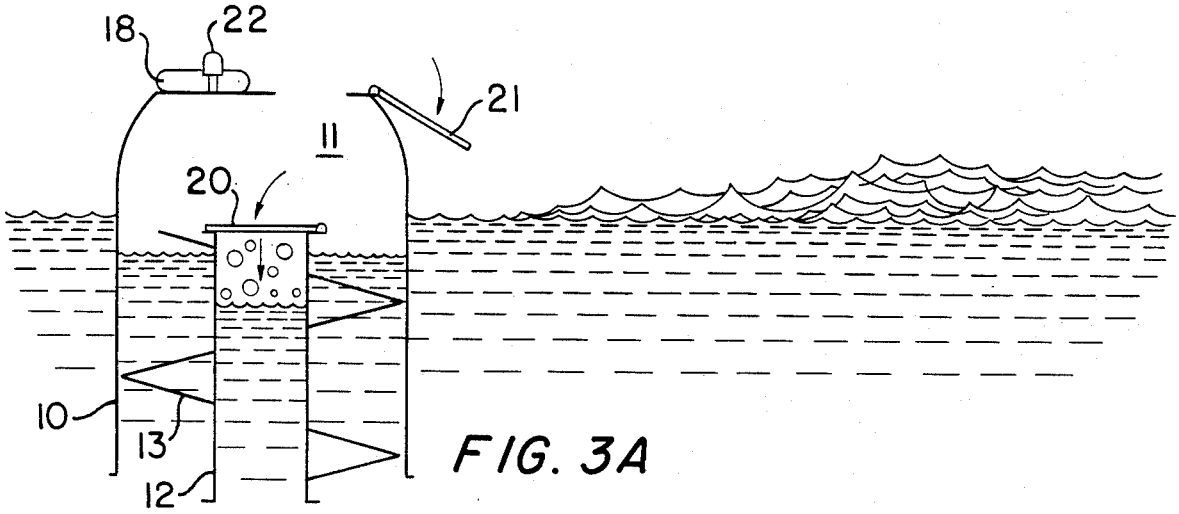
FIGS. 3A through 3D are schematic views showing the bell in different modes of operation.
Figure 3B:
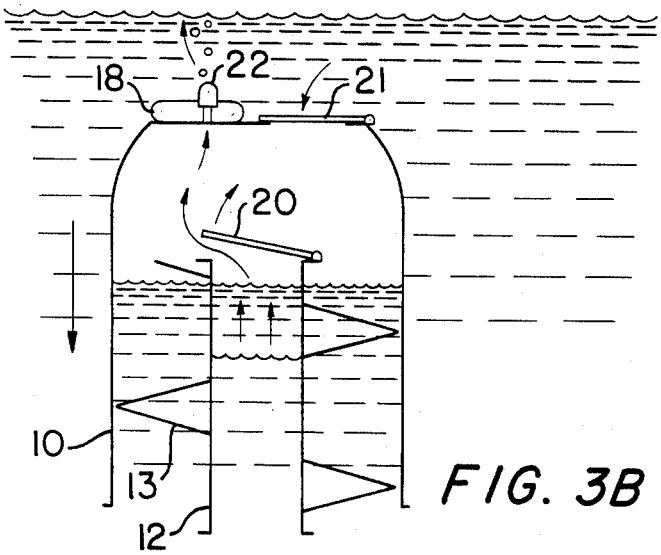
Figure 3D:
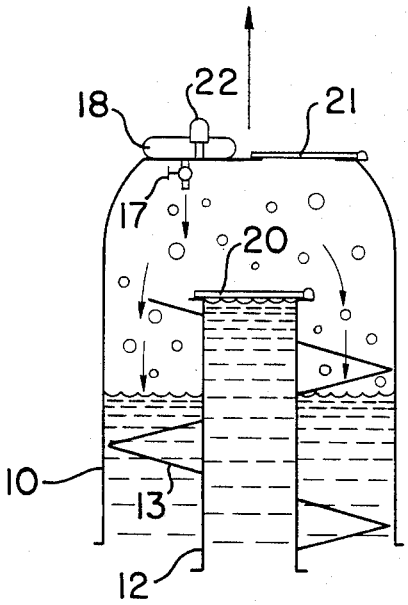
Figure 3C:
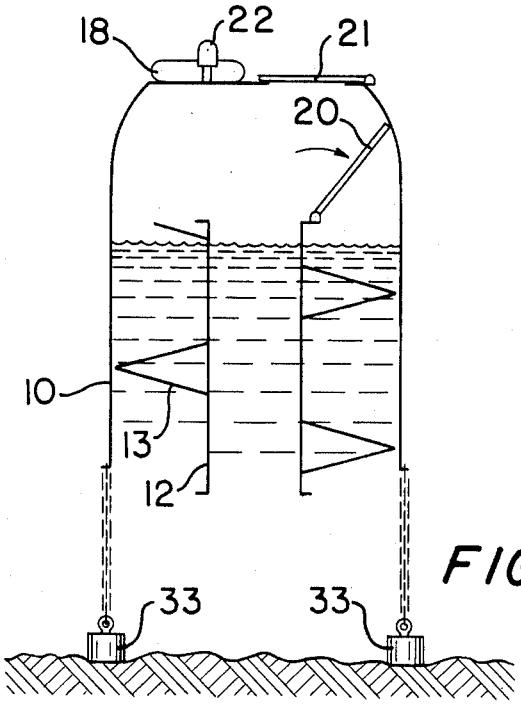

The operation of the submersible bell in its various modes is illustrated in FIGS. 3A to 3D. The bell will float when the hatch door 21 is closed and the diver's compartment is adequately pressurized. Also, as shown in FIG. 3A, the bell will float when the hatch door 20 is closed and a sufficient amount of air is entrapped in the upper region of the axial conduit 12 of the bell. With the hatch door 21 closed, the bell can be submersed by opening the hatch door 20, permitting air to be purged from the bell through the air purge and valve device 22. While submerged, air can be supplied to the diver's compartment through the umbilical conduit or the air tank. As shown in FIG. 3C, the bell can be maintained at the bottom of the water by anchors or weights 33. For liftup, as shown in FIG. 3D, additional air can be supplied to the diver's compartment. The bell can be tilted and oriented to different positions by strong currents or rough water while maintaining the air within the diver's compartment 11.

Figure 4:
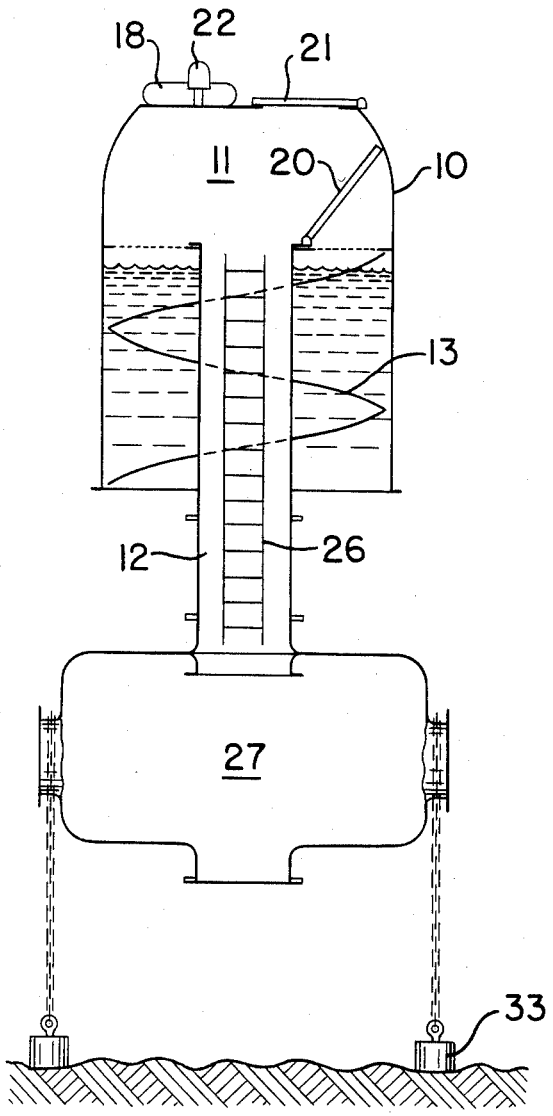
FIGS. 4, 5 and 6 are elevational views illustrating different underwater stations in which the submersible bell of the present invention is used to purge air from a divers' compartment and/or permit a diver to enter and leave the compartment.

An application of the bell of the present invention for facilitating entrance to and egress from an underwater diver's station or compartment 27 is shown in FIG. 4. In this embodiment, the entrance to and egress from the compartment 27 is through the winding passage defined by the spiral wall 13. The axial conduit 12 connects the compartments 11 and 27.

Figure 5:
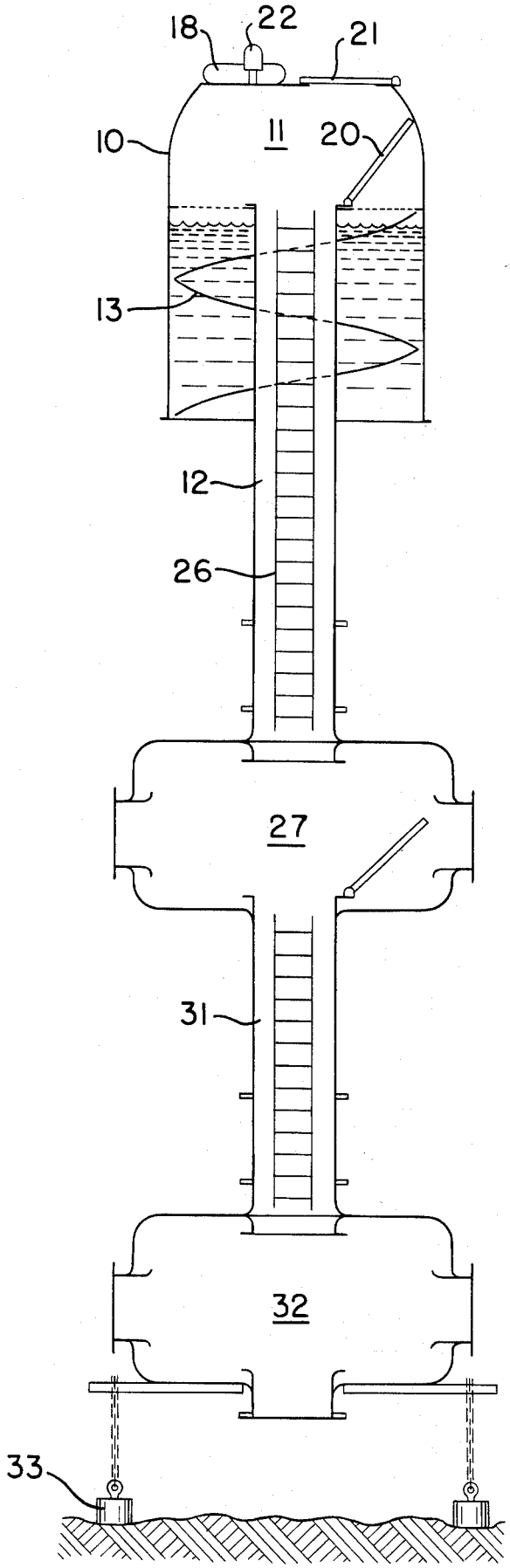

In the underwater station shown in FIG. 5, the compartment 27 is connected by a vertical conduit 31 to another diver's compartment 32. The underwater stations shown in FIGS. 4 and 5 are held submerged by anchors or weights 33.

Figure 6:
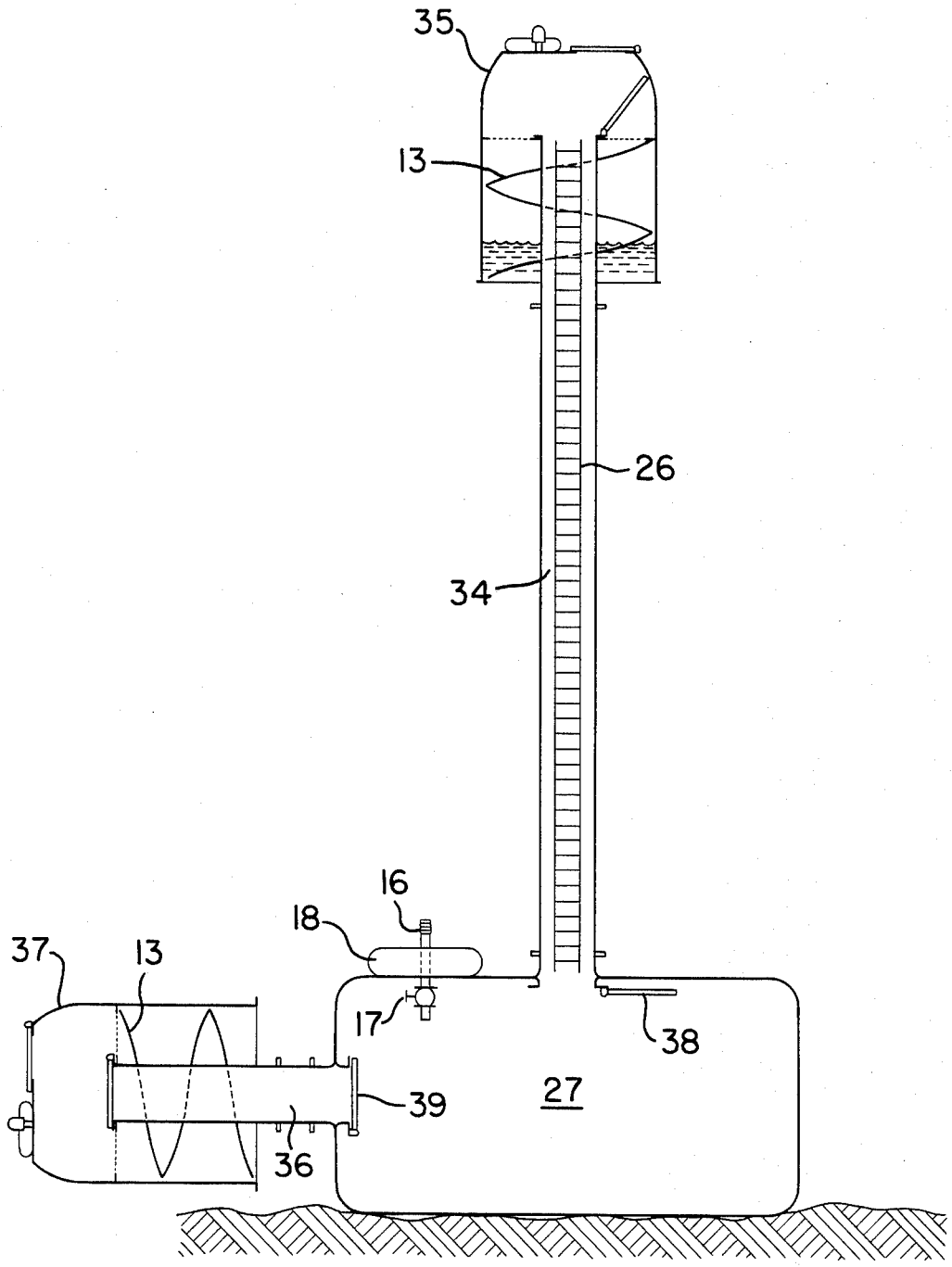

In the underwater station shown in FIG. 6, the diver's compartment 27 is connected by a vertical conduit 34 to the interior of an upper bell 35 and by a horizontal conduit 36 to the interior of a bell 37 disposed laterally of the compartment 27. Both bells are connected to the ambient water through winding passages defined by spiral walls 13 between the bells and their respective conduits. The bells 35, 37 and conduits 34, 36 provide entrance to and egress from the compartment and means for purging the compartment 27. Air or oxygen is supplied to the compartment 27 through an umbilical conduit 16 and/or from a tank 18.

The compartment 27 is provided with a hatch door 38 to close the lower end of the conduit 24 and a hatch door 39 to close the inner end of the conduit 36. Since the bells are submersed at different levels, the pressures in the bells will be unequal, so that one of the hatch doors 38, 39 should be closed while the other is open.

The invention has been shown in preferred forms and by way of example, and many modifications and variations are possible within the spirit of the invention. The invention is not intended to be limited to any particular form or embodiment except insofar as such limitations are expressly set forth in the claims.

I claim:

1. A submersible bell adapted to be submersed under water comprising a chamber within the bell for entrapping air therein when the bell is submersed, a diver's compartment in the upper region of the chamber, a depending conduit which extends from the diver's compartment within the chamber of the bell, and a spiral wall within the bell chamber intermediate the depending conduit and the bell for providing a winding passage through the bell chamber intermediate the depending conduit and the bell and extending from the diver's compartment to the water surrounding the submersed bell, said passage being in open communication at one end with the diver's compartment and at the other end with the surrounding water.

2. A submersible bell as set forth in claim 1 in which the conduit is in comunication at its lower end with the ambient water.

3. A submersible bell adapted to float or be submersed under water as set forth in claim 2, including means for closing the depending conduit from the diver's compartment to entrap air in the conduit for controlling the buoyancy of the bell.

4. A submersible and floatable bell as set forth in claim 2 including a hatch door in the upper region of the bell which can be opened when the bell is floating and means for closing the depending conduit to entrap air in the upper region of the conduit for controlling the buoyancy of the bell.

5. A submersible bell as set forth in claim 1 including another diver's compartment connected to the compartment within the bell through the depending conduit.

6. A submersible and floatable bell as set forth in claim 1 including an atmospheric purge and valve means to permit the purge of air from the air compartment when the bell is floating or submerged, while preventing entry of the ambient water when the bell is submerged.

7. A submersible bell as set forth in claim 1 including a floor within the bell defining the diver's compartment and an opening in the floor communicating with said one end of the winding passage to permit the diver to enter and leave the diver's compartment through the winding passage.

8. A submersible bell as set forth in claim 1 including a ladder in the depending conduit to permit the diver to ascend and descend through the conduit.

9. A bell adapted to be submersed under water for purging air from an underwater diver's compartment comprising a chamber within the bell for entrapping air therein when the bell is submersed, a conduit in communication with the chamber within the bell at one end of the conduit and with the diver's compartment at the other end and means defining a winding passageway within the chamber between the bell and the conduit to connect the ambient water when the bell is submersed with the air in the bell, the air pressure within the bell permitting the purge of air from the compartment while preventing the flow of water into the compartment.

10. A bell as set forth in claim 9 in which the winding passageway is large enough to permit a diver to enter and leave the diver's compartment through the bell.

11. A pair of bells adapted to be submersed at different levels underwater for purging air from an underwater diver's compartment comprising a chamber within each bell for entrapping air therein when the bell is submersed, conduits connecting the diver's compartment with the chambers within each bell, means defining a winding passageway within the chamber of each bell between each bell and its respective conduit to connect the ambient water with the air within the chamber of each bell, the air pressure within the chamber of each bell permitting the purge of air from the compartment while preventing the flow of water into the compartment, at least one of the winding passageways permitting a diver to enter and leave the diver's compartment.

12. A pair of submersed bells as set forth in claim 11 including separate hatch doors within the diver's compartment for closing and opening the conduits.

* * * * *